United States Patent [19]

Hattori

[11] 4,327,815

[45] May 4, 1982

[54] ROTATIONAL MECHANISM DISPOSED WITHIN FLUID PASSAGEWAY

[76] Inventor: Tetsuo Hattori, 212, Kaechi, Kaniehommachi, Kanie-cho, Ama-gun, Aichi-ken, Japan

[21] Appl. No.: 92,281

[22] Filed: Nov. 8, 1979

[30] Foreign Application Priority Data

Nov. 13, 1978 [JP] Japan ..... 53-139573
Nov. 25, 1978 [JP] Japan ..... 53-145560

[51] Int. Cl.[3] ..... F01N 1/08
[52] U.S. Cl. ..... 181/225; 181/226; 181/255; 181/277; 181/281; 415/60; 415/119
[58] Field of Search ..... 181/225, 226, 255, 277, 181/281, 240, 404; 415/119, 208, 97–103, 60; 60/280, 315, 317

[56] References Cited

U.S. PATENT DOCUMENTS 1,885,062 10/1932 Nicolich ..... 181/277
2,358,744 9/1944 Stepanoff ..... 415/97

FOREIGN PATENT DOCUMENTS 598452 5/1960 Canada ..... 60/315

*Primary Examiner*—L. T. Hix
*Assistant Examiner*—Benjamin R. Fuller
*Attorney, Agent, or Firm*—Browdy and Neimark

[57] ABSTRACT

A rotational mechanism to be disposed midway in a fluid passage may be utilized in a silencer, rotary pump, or the like. The mechanism is essentially provided with a casing defining a spherical chamber, a pair of shafts respectively having axes passing through the center of the interior space of the casing and crossing each other in a plane substantially perpendicular to the flow direction of the fluid, and a pair of impellers having at least two flat plate vanes and at least two bent vanes alternately positioned to the flat plate vanes. The impellers are related to each other such that one flat plate vane is abutted on one bent vane of the other impeller so that every two vanes can constantly partition the spherical space to be able to diminish the noise of the flow or to transport the fluid as a rotary pump with one impeller being driven and the other impeller being idly rotated, by making isolated spaces of different volume for creating the force of pushing away the fluid.

13 Claims, 12 Drawing Figures

1
2
3
4
5
6
20
5a
5b
8a
8b
8c
8d
13a
13b
14
150°
7a
7b
9a
9b
10a
10b
11a
11b
12a
12b
13a
18a
14
17a
16b
15b
17b
9b
11b'
7b'
24
23
21
22

ROTATIONAL MECHANISM DISPOSED WITHIN FLUID PASSAGEWAY

BACKGROUND OF THE INVENTION

This invention relates to a rotational mechanism disposed within a fluid passageway and more particularly to a silencer (muffler) provided with a rotational mechanism disposed within a noisy air or gas stream for effectively muffling the noise thereof. The invention, and further relates to a rotary pump (including a rotary fan and called simply rotary pump hereinafter) of capacity the or displacement type provided with a rotational mechanism disposed within a fluid passageway which is positively driven by external driving means for transporting the fluid.

Silencers are generally mounted in an exhaust gas pipe of an internal-combustion engine for damping the noise of the exhaust gas, and the structural gist of the silencers of such type resides in (1) making the diameter of the silencer larger than that of the exhaust gas pipe or narrowing the passage of the exhaust gas for expanding and compressing the exhaust gas to diminish the force thereof, and (2) obtaining repeated sound reflections of the exhaust gas by means of bending or winding the passageway, for thereby effectively damping the exhaust gas noise.

In recent years the noise of enlarged engines of model planes, particularly those with engines controlled by wireless radio means, has become a source of a kind of noise problems. For the model planes with large engines silencers of the rotary impeller type (which are provided with a simple wind wheel) are employed.

Such conventional silencers are relatively of large size for the size of the engine and occupy a large space, so miniaturization is required from the standpoint of weight reducing and fine appearance. However, the requirement for miniaturization and the convenient reduction in noise preventive effect caused by the miniaturization are two contradictory problems.

Capacity type pumps or displacement pumps are generally machines for transporting fluid under pressure by means of the action of pushing away or displacing the fluid with a piston, plunger, rotor, or the like. Such pumps are generally classified into reciprocation and rotation types. Pumps of the rotation type are characterized by the portion which pushes away or displaces the fluid rotating. Gear pumps, screw pumps, cam pumps, vane pumps, etc., are examples of the rotation type. Among displacement type pumps are included those with two shafts and a mechanism wherein a pair of rotors are mounted in a casing on parallel axes offset from each other for being rotated in opposite directions for transporting fluid. Pumps of this type are preferably utilized where it is required that the amount of fluid to be discharged be moved in proportion to pump rotor speed. The discharge of this type of pump is substantially proportional to the rotation of the rotors. This type has generally been believed to be not preferred for transporting large amounts of fluid because of such problems as (1) requiring precise machining in the manufacturing thereof, (2) being relatively large and heavy in weight, and (3) being unsuitable for high speed rotation.

SUMMARY OF THE INVENTION

It is therefore a primary object of this invention to provide a rotational mechanism which can be preferably utilized in silencers, rotation type pumps, etc., and which is capable of completely eliminating the disadvantages that often occurred in the prior art.

It is another object of this invention to provide a silencer for restraining diffusion of the noise in a noisy air (gas) current, in particular, a silencer which is mounted in an exhaust gas pipe of an internal-combustion engine for concurrently discharging the exhaust gas and also diminishing the noise thereof.

It is still another object of this invention to provide a novel rotary pump which is provided with a plurality of impellers of light weight and suitable for transporting a large amount of fluid at high speeds rotation.

Other objects of this invention will become apparent to those skilled in the art from the following detailed description of the preferred embodiments when read in connection with the accompanying drawings.

A rotational mechanism in accordance with this invention having the above-mentioned objects is provided with (1) a casing of spherical form in its interior, which is disposed midway in a passage of fluid flowing from one side to the other; (2) a pair of shafts respectively having an axial line which passes through the center of the spherical space or chamber within the casing and cross each other at that center in a plane substantially perpendicular to the flow of the fluid; and (3) a pair of impellers attached respectively to the pair of shafts for rotating thereabout along the inner surface of the spherical interior of the casing, each impeller being provided with at least two flat vanes and at least two bent vanes alternately positioned with the flat vanes and bent in the direction of rotation. Each flat plate vane of one impeller is contacted by a bent vane of the other impeller so as to constantly and dynamically partition the spherical space or chamber in the casing interior by this alternate interfolding of the two kinds of vanes.

In a silencer, which is one exemplary use of the rotational mechanism the invention, the rotational mechanism per se is disposed inside the main body of the silencer, and a noisy air current is passed through the pair of impellers for noise muffling while passing therethrough. This invention has thus succeeded in the provision of a silencer of compact size and light weight which is highly improved in noise muffling.

DETAILED DESCRIPTION OF THE PREFERRED EMBODIMENTS

Figures 1, 2, 7, 8:
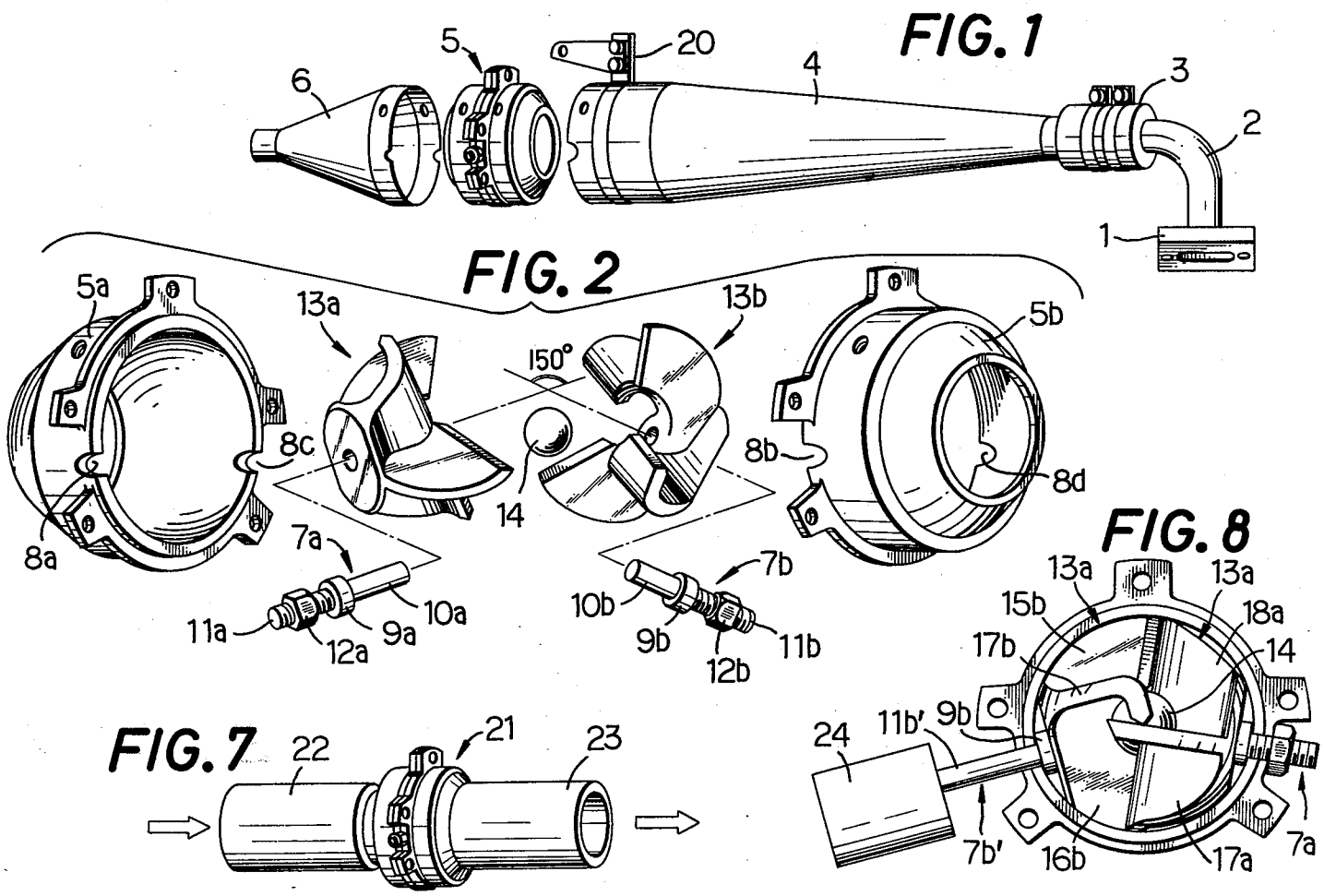
FIG. 1 is a partly exploded perspective view of an embodiment of a silencer of this invention.
FIG. 2 is an exploded perspective view of the main body of the silencer.
FIG. 7 is a perspective view showing use of a rotary pump as another embodiment of this invention.
FIG. 8 is an elevational view of the rotary pump of FIG. 7 which corresponds to FIG. 3.

In FIG. 1 a silencer in accordance with this invention is shown mounted in a model plane engine. In the drawing, 1 designates an exhaust outlet and 2 designates an exhaust gas pipe which is connected by a sleeve 3 to an expansion pipe 4 of the silencer (a funnel shaped pipe having a gradually enlarged diameter). The larger end of exhaust gas pipe 4 is formed into a cylindrical shape for being fitted with screws to one end of on the outer periphery of a casing 5 of the main body of the silencer. On its outer periphery at its other end, the casing 5 is also fitted with a funnel shaped compression pipe 6 having a gradually decreasing diameter, which is similarly fixed with screws. The expansion pipe 4, the casing 5, and the compression pipe 6 constitute the mentioned silencer. At the cylindrical portion of the expansion pipe 4 is fixed a support fitting 20 for supporting and positioning the silencer.

As shown in FIG. 2, the casing 5 of the silencer consists of two halves or half-sections 5*a* and 5*b*, one being the inlet and the other the outlet. The inner surfaces of the two halves 5*a* and 5*b*, when the halves are assembled, define a spherical chamber or space communicating with the expansion and compression pipes 4 and 6 through the inlet and outlet formed in the halves. The two halves 5*a* and 5*b* are connected by a machined faucet type joint (socket-spigot joint) to each other at a plane which is substantially perpendicular to the line of flow of the exhaust gas and which passes through the center of the spherical chamber. The two halves are fastened together with screws.

A pair of shafts 7*a* and 7*b* respectively having an axial line passing through the center of the spherical chamber and crossing each other at an angle of about 150° are fixedly supported in a pair of circular holes which are formed in the facing surfaces of the half casings 5*a*, 5*b*. These mounting holes are defined by two sets of a pair of semicircular recesses 8*a*, 8*b* and 8*c*, 8*d*. Shafts 7*a* comprises a rod-like body provided substantially at its middle circular shoulder or enlarged diameter thereof with a step portion 9*a* having a relatively thick wall. About half of the shaft 7*a* is a round rod portion 10*a* and the other half is a male threaded portion 11*a* which carries a nut 12*a*. Similarly, the other shaft 7*b* is comprises a shoulder portion 9*b*, a round rod portion 10*b*, male threaded portion 11*b*, and a nut 12*b*.

The shafts 7*a* and 7*b* are fixed to the wall of the casing 5 so that the wall is sandwiched beween the shoulder portions 9*a* and 9*b* and nuts 12*a* and 12*b* on the shafts, respectively. In the interior of both half casings 5*a*, 5*b* are respectively disposed impellers 13*a* and 13*b* which are rotatably mounted on the round rod portions 10*a* and 10*b*. The impellers slidably contact the inner surface of the casing 5. A steel ball 14 is stationarily supported at the center of the spherical space by being sandwiched between the impellers 13*a* and 13*b*, axial, which restricts shifting of the impellers 13*a*, 13*b*.

Figure 3:
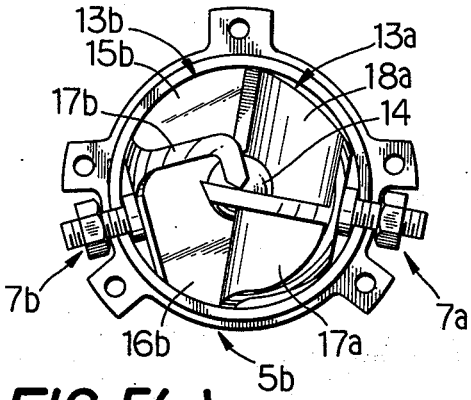
FIG. 3 is an elevational view of the main body of the silencer, with one half of the casing removed.
Figure 5A:
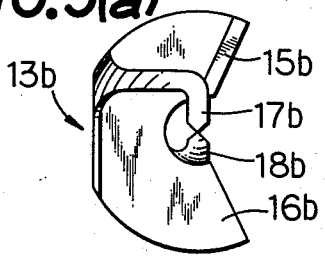
FIGS. 5 (*a*)–(*c*) show, respectively, an elevation, plan, and profile of the other impeller.
Figure 4A:
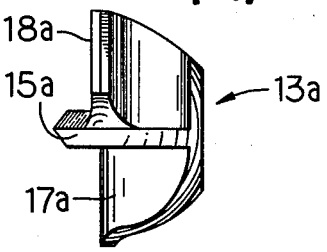
FIGS. 4 (*a*)–(*c*) show, respectively, an elevation, plan, and profile of one impeller.
Figure 5B:
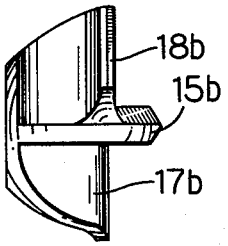
Figure 4B:
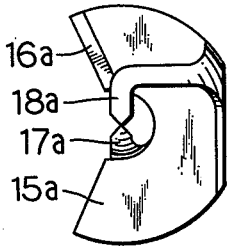
Figure 5C:
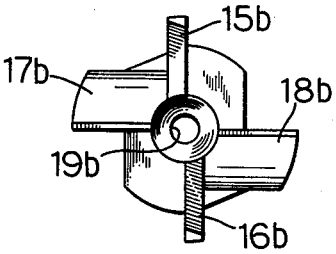
Figure 4C:
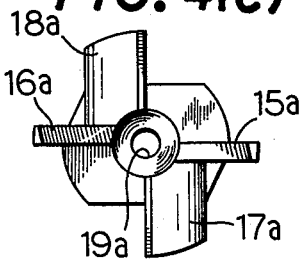

The impeller 13*a* is, as shown in FIGS. 4 (*a*)–(*c*), is provided with a pair of flat plate vanes 15*a*, 16*a* and a pair of bent vanes 17*a*, 18*a* disposed alternately with respect to each other. A through-bore 19*a* formed on the rotational center line, which allows mounting of the impeller the round rod portion 10*a*. Similarly, the other impeller 13*b* is, as shown in FIG. 5 (*a*)–(*c*), is provided with a pair of flat plate vanes 15*b*, 16*b* and a pair of bent vanes 17*b*, 18*b*, which are disposed alternately with respect to each other, and are positioned in an interfolded alternate manner with respect to the vanes on impeller 13*a*. A throughbore 19*b* is formed on the rotational center line, which allows the mounting of the impeller on the round rod portion 10*b*. As can be seen in FIG. 3 the impellers 13*a*, 13*b* are assembled or put together such that the end of each bent vane of one impeller is in contact with the facing surface of a flat vane of the other impeller for sliding motion therealong. The contacting surface of each flat vane is within a plane which includes the rotational axis thereof, and the contacting end edge of each bent vane is one straight line which passes through the center of the spherical chamber perpendicular to the rotational axis of that impeller. In other words, on each of the flat vanes 15*a*, 16*a* is abutted respectively each of the bent vanes 18*b*, 17*b*, and on each of the bent vanes 17*a*, 18*a* is respectively abutted each of the flat vanes 15*b*, 16*b*, for sliding movement. When impellers 13*a*, 13*b* are rotated in this condition the air currents through the impellers are almost completely isolated from each other with virtually no gaps or clearances. The action of the bent vanes is uniform in either direction.

The base portion of each impeller 13*a*, 13*b* is formed into a cylindrical or slightly conical shape, from which the integral flat and bent vanes extend. When the impellers 13*a*, 13*b* are rotated with the outer periphery of the base portion and the outer ends of the flat and bent vanes in sliding contact, as shown in FIG. 3, to the inner surface of the spherical chamber defined by the casing halves 5*a*, 5*b* complete separation of the flow through the casing 5 is provided.

Figure 6:
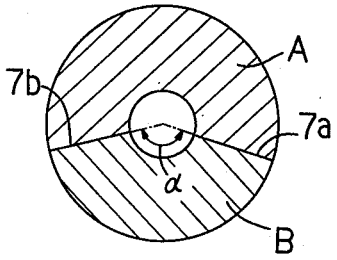
FIG. 6 is a drawing illustrating the cross-sectional projectional areas A and B, as viewed in the air flow direction, on the rotary vanes within their chamber and which receive the force of air the current chamber within the space partitioned into two parts by the both axes.

When the exhaust gas of the engine is led from the exhaust outlet 1, through the exhaust gas pipe 2, to the expanded exhaust gas pipe 4, the gas is expansion in the expansion exhaust gas pipe 4, and gives a surface pressure to the impellers, after having reached the main body 5 of the silencer at a reduced speed. Assume the two projectional areas (hatched portions) A and B which are formed by the angular separation of the two rotary shafts 7*a*, 7*b*, as shown in FIG. 6, of the rotary impellers which receive the air current in its flowing direction, A is larger than B (A>B) because the shafts cross each other at the angle $\alpha$ of 150°. The resultant force acting on area is therefore of course larger than that acting on area B. The impellers are therefore given a rotational force in the direction of pushing away of the impellers in.

The volume of the partitioned spaces by the rotary impellers in the spherical space is also larger in the former than in the latter, so the exhaust gas is passed through the main body 5 of the silencer to the compression pipe 6 due to the rotation of the impellers, and is finally discharged into the atmosphere under a slight compression. The noise of the exhaust gas is muffled by the vanes of the impellers because one or two sets of the flat and bent vanes constantly partition the spherical chamber in the casing 5 during rotation of the impellers.

The impellers 13*a*, 13*b* are usually rotated at a high speed of about 10,000 r.p.m. Since some oil is contained in the exhaust gas, there especially for two-cycle engines, is no need for extra oil for the lubrication of the impellers because the contained oil in the exhaust gas suffices.

The above description is of an embodiment applied to a model plane engine. This is however only an exemplary application of the present invention, which can be of course widely applied, such as to motorcycles, motorized bicycles, automobiles, compressors, and any other places where exhaust gas noise is to be muffled.

The above description is of an embodiment wherein two of the flat vanes and two of the bent vanes are disposed alternately, but the present invention is not limited to this type only.

The steel ball 14 is disposed, in this embodiment, at the center of the spherical space in the casing interior, but it may be replaced by other means, for example, a mating projected portion and a recessed portion formed on each of the impellers 13*a*, 13*b*, which are capable of restricting the axial movement of the impellers while allowing the impellers to rotate on their own axes.

The crossing angle $\alpha$ between the two shafts 7*a*, 7*b* is not limited to 150° as in this embodiment. A little plus or minus can be allowed of course. The smaller the angle $\alpha$ is, the greater becomes the difference of the surface pressure acting on the rotational vanes, which advantageously increases the rotational force of the impellers. When the angle $\alpha$ is too small there is a likelihood of interference between the vanes of the impellers. The most preferable angle $\alpha$ ranges between 140° and 170° according to my study. Making the angle $\alpha$ equal to 180° ($\alpha=180°$) is not desirable because no rotational force is produced and the noisy air or gas current does not pass through.

The silencer in this invention can be rotated extremely easily due to its structure, so it can be driven at a high speed because of the easy passage of the exhaust gas and little power loss. It also enjoys an extremely high effect of noise muffling in comparison to the prior art such as ordinary wind wheels or turbines, because of the one or more pairs of vanes of opposite kinds constantly partition the exhaust gas passage. In addition to the above-mentioned excellent noise muffling effect, it is also very effectively applicable to motorcycles, model planes, etc., where the design of reducing air resistance is particularly required, because the silencer of this invention can be small size and light weight due to its reduced number of component parts.

The above description is concerned with the application of this invention to a silencer, but the present invention is also very effectively applicable to a rotary pump.

In FIG. 7 a rotary pump provided with a rotational mechanism of this invention is generally designated by 21. 20 the inlet portion and the outlet portion are respectively fitted an intake pipe 22 and a discharge pipe 23.

The inside structure of this pump is entirely identical to that of the above-mentioned silencer, only except for shaft (7*b*′) of one impeller (13*b*), and therefore the further detailed description and illustration are omitted herein. Reference to FIG. 2, and FIGS. 4–6 will be sufficient for the full understanding. As shown in FIG. 8 which corresponds to FIG. 3, the shaft 7*b*′ is a rod-like member having midway a large diameter portion 9*b* with a thick wall. One end of the shaft 7*b* is externally threaded for screwing thereon the rotary impeller and on the other end thereof is disposed a drive shaft 11*b* which is driven by a well-known driving source 24.

With reference to FIG. 3 which indicates a pair of assembled impellers 13*a*, 13*b*, flat plate vanes 15*b*, 16*b* on the drive side are respectively abutted on bent vanes 18*a*, 17*a* on the driven side and bent vanes 17*b*, 18*b* on the drive side are respectively abutted on the surface of the flat plate vanes 15*a*, 16*a* on the driven side such that the tip of the bent vane is slidable on the surface of the flat plate vane. And this surface of the flat plate vane is in a plane including the respective rotation axis of the impeller; the contact tip of the bent vane is on a straight line, which passes the center of the spherical space and perpendicular to the rotational axis.

As mentioned above, when the pair of impellers 13*a*, 13*b* are rotated the fluid on either side of the impellers is almost completely secluded (isolated) by the mating pairs of vanes of the impellers which provide a clearance-free partition.

When the shaft 7*b*′ is driven by the driving source 24 and the impeller 13*b* is rotated, the other impeller 13*a* which engages the former will be idly rotated on the other shaft 7*a*. Assuming here the cross-sectional area of the impellers 13*a*, 13*b* driven by the shafts 7*a*, 7*b* are designated by characters A and B (hatched portions in FIG. 6), then there is a relation between the two areas that A is larger than B because both shafts cross each other at an angle $\alpha$ of about 150°. As to the volumes A′ and B′ of the two sections defined by the impellers and the casing, there exists a relation of $A'>B'$.

When the impellers 13*a*, 13*b* are rotated in the casing 5*a*, 5*b* filled with the fluid, the volume A′ of fluid is pushed forward and the volume B′ of fluid is withdrawn. Consequently the difference $(A'-B')$ between both volumes will be forwarded or discharged upon each rotation of the impellers due to piston action thereof. The fluid is moved from the intake pipe 22 to the discharging pipe 23 in FIG. 7, and the rotary pump 21 functions as a fluid feeding pump.

The rotary pump 21 of this embodiment is, in comparison to the gear pumps, screw pumps, cam pumps, etc., mentioned above, light in weight because it is relatively thin walled all over, and has a low sliding resistance because of the presence of a slight gap between the inner spherical surface of the casing 5*a*, 5*b* and the vanes, that is there is no sliding portion. This pump is capable of high speed rotation and suitable for mass transportation of fluid because its displacement amount is proportional to the number of rotation of the impellers.

Besides, the rotary pump of this invention is applicable not only in the transportation of liquid material but also as a rotary fan which transports air or gas. The scope of this invention includes, of course, all of such applications.

The dominant features of the pump in accordance with this invention include, (1) capability of high speed operation and mass fluid transportation because of its light-weight structure, low-resistance rotation, and increase in transportation amount in proportion to the number of rotation; and (2) adaptability to liquid transportation as well as gas transportation because of its reduced number of component parts and the resultant reduction in the pump size.

What is claimed is:

1. A rotational mechanism disposed in a fluid passageway comprising:

a casing defining an interior chamber of spherical form;

a pair of shafts respectively having an axial line passing through the center of said interior space and crossing each other in a plane substantially perpendicular to the flow of said fluid;

the axes of said shafts defining an angle therebetween in said plane other than about 180°;

a pair of impellers respectively attached to said pair of shafts for rotation within said spherical chamber, said impellers respectively having at least two flat vanes and at least two bent vanes alternately positioned to said flat vanes, an edge of each bent vane being in sliding contact with a face of a flat vane on the other impeller, and all of said vanes being in sliding contact with the inside wall of said casing defining said spherical chamber, whereby when said impellers are rotated, one bent vane of one impeller is abutted on one flat vane of the other impeller so that said interior space of said casing is partitioned by means of the contacting between the two kinds of said vanes.

2. A mechanism as claimed in claim 1, wherein the axes of said pair of shafts cross each at an angle in the range of about 140° to about 170°.

3. A mechanism as claimed in claim 1, wherein said angle is about 150°.

4. A mechanism as claimed in claim 1, and ball means supported by both impellers and positioned at the center of the sperical chamber for restraining the axial movement of both impellers.

5. A mechanism as claimed in claim 1, wherein the fluid drives said impellers whereby said mechanism functions as a silencer for said fluid.

6. A mechanism as claimed in claim 1, wherein an independent power source drives at least one of said impellers, whereby said mechanism functions as a rotary pump for said fluid.

7. A mechanism as claimed in claim 1, wherein said bent vanes are bent in the direction in which said impellers are rotated.

8. A mechanism as claimed in claim 1, wherein said casing is formed with a pair of apertures for mounting said pair of shafts respectively, each of said shafts comprising a shoulder portion intermediate its ends and being formed with means to rotatably mount one of said impellers on one side of said shoulder, and means to mount said shaft on said casing at the other side of said shoulder portion.

9. A mechanism as claimed in claim 8, wherein said casing comprises a pair of casing halves, and wherein said apertures are formed as pairs of facing aperture halves in the facing edge portions of said halves, and said halves mating in said plane.

10. A rotational mechanism disposed in a fluid passageway, the combination comprising:

(a) a casing having an inlet and an outlet at opposite ends thereof and consisting of a pair of halves one having said inlet and the other having said outlet, said inlet and said outlet communicating with said fluid passageway, the inner surfaces of said pair of halves defining a spherical chamber communicating with said passageway through said inlet and outlet to constitute a part of said passageway, said pair of halves being connected to each other at joint portions thereof in a plane passing the center of said spherical chamber and substantially perpendicular to the flow of said fluid;

(b) fastener means for securing said pair of halves to each other in a pressure-tight manner at joint portions thereof;

(c) a pair of shafts fixedly supported on said casing, each of said pair of shafts including one end portion extending into said spherical chamber in said plane such that axes of said shafts cross each other at said center at a predetermined angle;

(d) first and second impellers received within said casing and rotatable about said axes of said pair of shafts with base portions thereof being slidably in contact with said inner surfaces of said pair of halves, each of said first and second impellers comprising at least two flat vanes, and a corresponding number of bent vanes which are alternately disposed with respect to said flat vanes, the outer periphery of said flat and bent vanes being slidably in contact with said inner surfaces of said casing halves when said impellers are rotated, said bent vanes of each said impeller being abutted upon said flat vanes of the other said impeller, whereby mutually abutting pairs of said flat and bent vanes of said first and second impellers provide within said spherical chamber a substantially clearance-free partition dividing said spherical chamber into two isolated parts upon alternate contacting actions of said flat and bent vanes when said first and second impellers are rotated; and (e) ball means supported by said first and second impellers in a sandwiched manner and positioned at said center of said spherical chamber for restraining axial movements of said first and second impellers.

11. A mechanism as claimed in claim 10, wherein said predetermined angle falls within a range of about 140° and about 170°.

12. A mechanism as claimed in claim 10, wherein said predetermined angle is about 150°.

13. A rotating mechanism of the type comprising means defining a chamber housing a pair of impellers which rotate in opposite directions on axes which define a plane containing the center of the chamber, the improvement comprising positioning the axes of the impellers at a predetermined angle to each other in said central plane, and providing at least two bent vanes and two flat vanes on each impeller with the bent and flat vanes alternating with each other on each impeller, and with each bent vane on each impeller having an edge in sliding contact with the face of a flat vane on the companion impeller.

* * * * *